US006938289B2

(12) United States Patent
Morin

(10) Patent No.: US 6,938,289 B2
(45) Date of Patent: Sep. 6, 2005

(54) SIDERAIL MOUNTING ASSEMBLY

(75) Inventor: Marco Morin, Sainte-Foy (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/767,240

(22) Filed: Jan. 28, 2004

(65) Prior Publication Data

US 2005/0160527 A1 Jul. 28, 2005

(51) Int. Cl.[7] ..... A47C 21/08
(52) U.S. Cl. ..... 5/425; 5/427; 5/430
(58) Field of Search ..... 5/425, 427, 430

(56) References Cited

U.S. PATENT DOCUMENTS

| | | | | |
|---|---|---|---|---|
| 359,879 | A * | 3/1887 | Miller | 5/425 |
| 2,817,855 | A * | 12/1957 | Pratt | 5/430 |
| 3,081,463 | A * | 3/1963 | Williams et al. | 5/430 |
| 3,585,659 | A * | 6/1971 | Burst et al. | 5/430 |
| 4,747,171 | A * | 5/1988 | Einsele et al. | 5/425 |
| 4,985,946 | A | 1/1991 | Foster et al. | |
| 6,363,552 | B1 * | 4/2002 | Hornbach et al. | 5/425 |
| 6,691,345 | B2 * | 2/2004 | Nanahara | 5/430 |
| 2003/0093860 | A1 * | 5/2003 | Kramer et al. | 5/425 |

FOREIGN PATENT DOCUMENTS

| | | | | |
|---|---|---|---|---|
| EP | 428829 | * | 5/1991 | 5/430 |

* cited by examiner

*Primary Examiner*—Jong-Suk (James) Lee
(74) *Attorney, Agent, or Firm*—Flynn, Thiel, Boutell & Tanis, PC

(57) ABSTRACT

A bed siderail support assembly which includes a frame, a support deck mounted on the frame and having upwardly and downwardly facing sides. The support deck has a head end, a foot end and opposite lateral edges extending between the head end and the foot end. At least one siderail is oriented along side of at least one of the lateral edges and a connecting mechanism is provided which is configured to connect the siderail to either the frame or the downwardly facing side of the support deck. The connecting mechanism includes a support configured for securement to either the frame or the support deck, an elongate toothed rack longitudinally movably mounted on the support, a pair of parallel arms pivotally mounted on the support, a toothed pinion gear on each arm supported for meshing engagement with the toothed rack and a mount pivotally secured to each of the arms and being configured to support a bed siderail thereon.

15 Claims, 15 Drawing Sheets

SIDERAIL MEC. UP ISO

FOWLER 0° - THIGH 0° ISO

FOWLER 0° - THIGH 0° TOP

SIDERAIL MEC. DOWN RETRACTED ISO

SIDERAIL MEC. DOWN HALF RETRACTED ISO

SIDERAIL MEC. DOWN ISO

SIDERAIL MEC. HALF UP ISO

SIDERAIL MEC. DOWN RETRACTED TOP

FIG. 9 SIDERAIL MEC. DOWN HALF RETRACTED TOP

SIDERAIL MEC. DOWN FRONT

SIDERAIL MEC. HALF UP FRONT

SIDERAIL MEC. DOWN BACK

SIDERAIL MEC. HALF UP BACK

SIDERAIL MEC. UP BACK

SIDERAIL MOUNTING ASSEMBLY

FIELD OF THE INVENTION

This invention relates to a bed siderail support assembly and, more particularly, to a siderail support assembly that is configured for movement from a stowed position beneath a patient support deck to a fully deployed position oriented along side of the patient support deck.

BACKGROUND OF THE INVENTION

Beds with siderails are known. Many of the bed siderail support assemblies facilitate movement of the siderail to and between positions wherein the siderail is stored beneath the patient support deck to a fully deployed position whereat the bed siderail is oriented along side of the patient support deck. However, several of the known bed siderail support assemblies are difficult and cumbersome to operate and it is not immediately intuitive how the release mechanism for the siderail is to function in order to facilitate movement of the bed siderail from a fully deployed position to a retracted and stowed position to facilitate quick access to a person lying on the patient support deck.

Accordingly, it is an object of the present invention to provide a bed siderail support assembly which is intuitively operable to facilitate a quick movement of the bed siderail from a fully deployed position to a fully retracted and stowed position beneath the patient support deck.

It is a further object of the invention to provide a bed siderail support assembly, as aforesaid, with a mechanism for causing the bed siderail to move at a controlled speed from the fully deployed position to a retracted position to minimize the risk of injury caused by a rapid fall of the bed siderail toward the retracted position.

It is a further object of the invention to provide a bed siderail support assembly, as aforesaid, wherein the handle for effecting a release of the siderail when in the fully deployed position is mounted on the siderail and is intuitively operative to facilitate the release of the bed siderail to effect a movement thereof toward the retracted position.

It is a further object of the invention to provide a bed siderail support assembly, as aforesaid, which is sturdy when deployed and is of a durable construction.

SUMMARY OF THE INVENTION

The objects and purposes of the invention are met by providing a bed siderail support assembly which includes a frame, a support deck mounted on the frame and having upwardly and downwardly facing sides. The support deck has a head end, a foot end and opposite lateral edges extending between the head end and the foot end. At least one siderail is oriented along side of at least one of the lateral edges and a connecting mechanism is provided which is configured to connect the siderail to either the frame or the downwardly facing side of the support deck. The connecting mechanism includes a support configured for securement to either the frame or the support deck, an elongate toothed rack longitudinally movably mounted on the support, a pair of parallel arms pivotally mounted on the support, a toothed pinion gear on each arm supported for meshing engagement with the toothed rack and a mount pivotally secured to each of the arms and being configured to support a bed siderail thereon.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
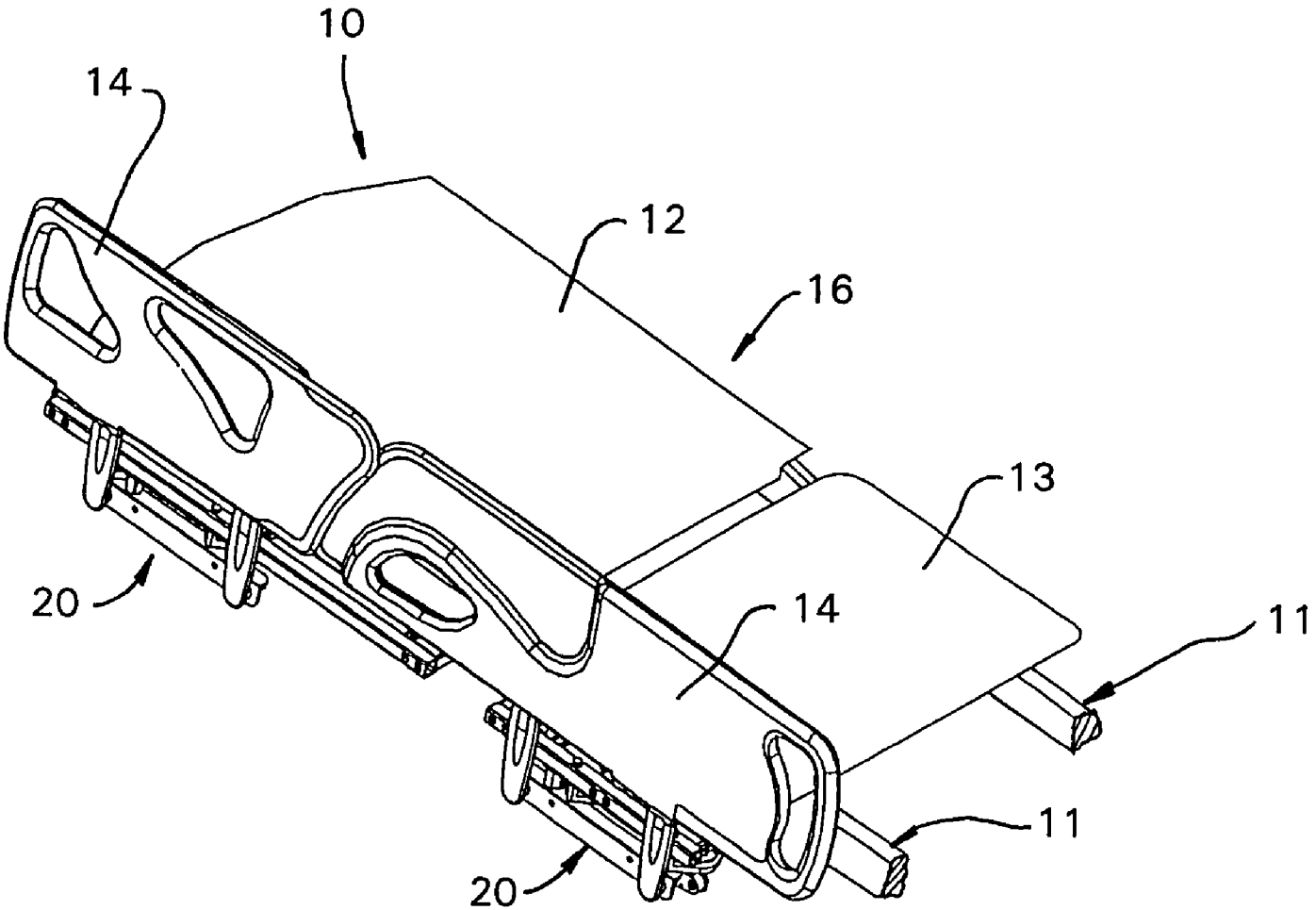
FIG. 1 is an isometric view of a bed siderail support assembly embodying the invention.

FIG. 1 is an isometric view of a bed 10 having a frame 11 and a head end section 12 and a seat and thigh section 13, hereinafter referred to as the seat section, mounted on the frame 11. A foot end section (not illustrated) is not deemed part of this invention and, accordingly, it is not shown in the drawings nor described herein. Drive mechanisms (not illustrated) are provided for effecting a relative movement between the head end section 12 and the seat section 13. The bed 10 has two pairs of bed siderails 14 provided along opposite lateral edges of the patient support deck 16 defined by the illustrated head end section 12 and seat section 13. A bed siderail support assembly 20 is provided for each siderail 14. As illustrated in FIG. 1, only one side of the bed 10 is illustrated as having the bed siderails 14 thereon. Since the bed siderail support assemblies 20 are each identical to one another, only one bed siderail support assembly will be described herein, it being understood that the applicability of the disclosed structure applies to all of the bed siderail support assemblies mounted on the bed 10.

Figure 7:
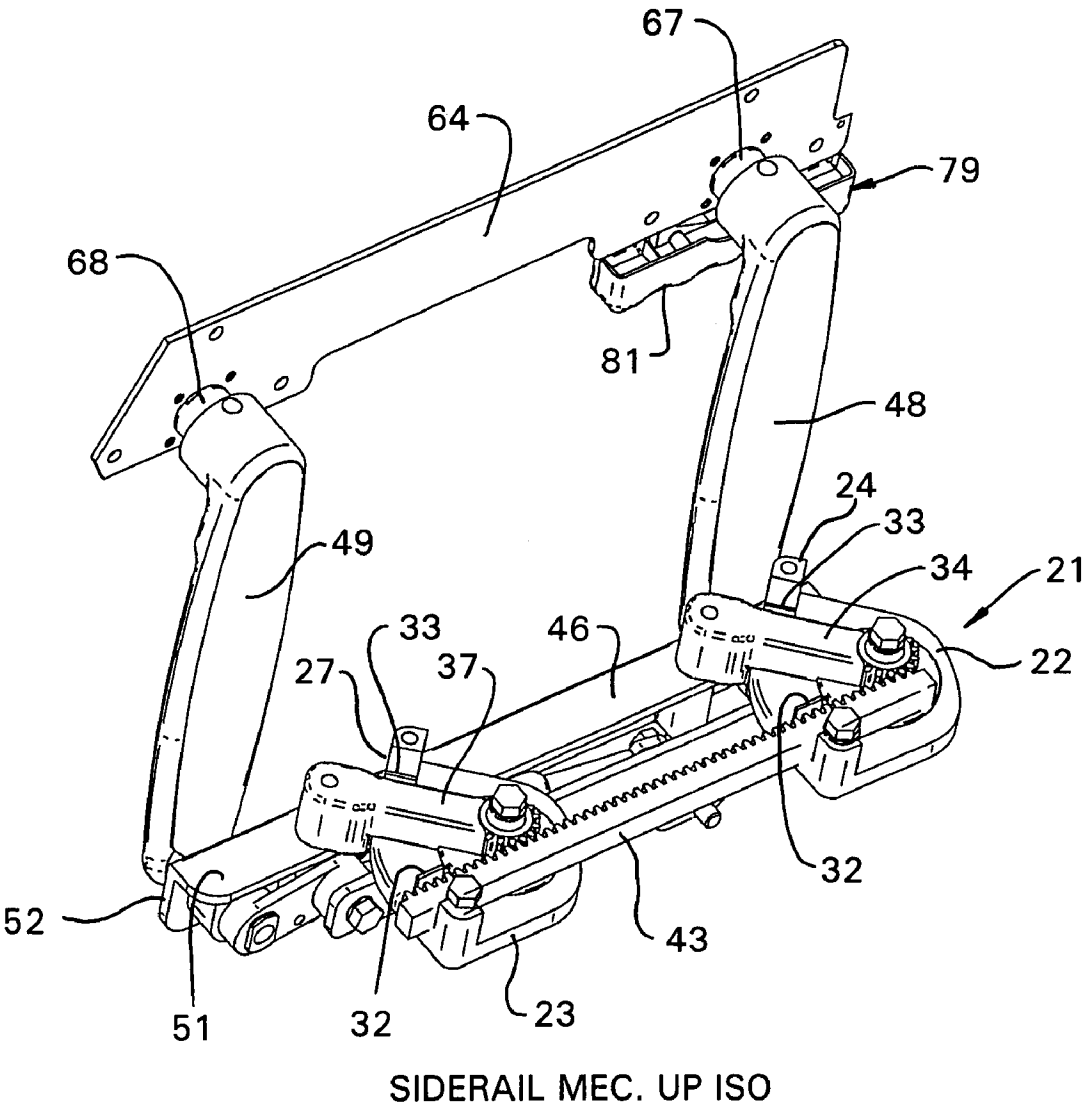
Figure 8:
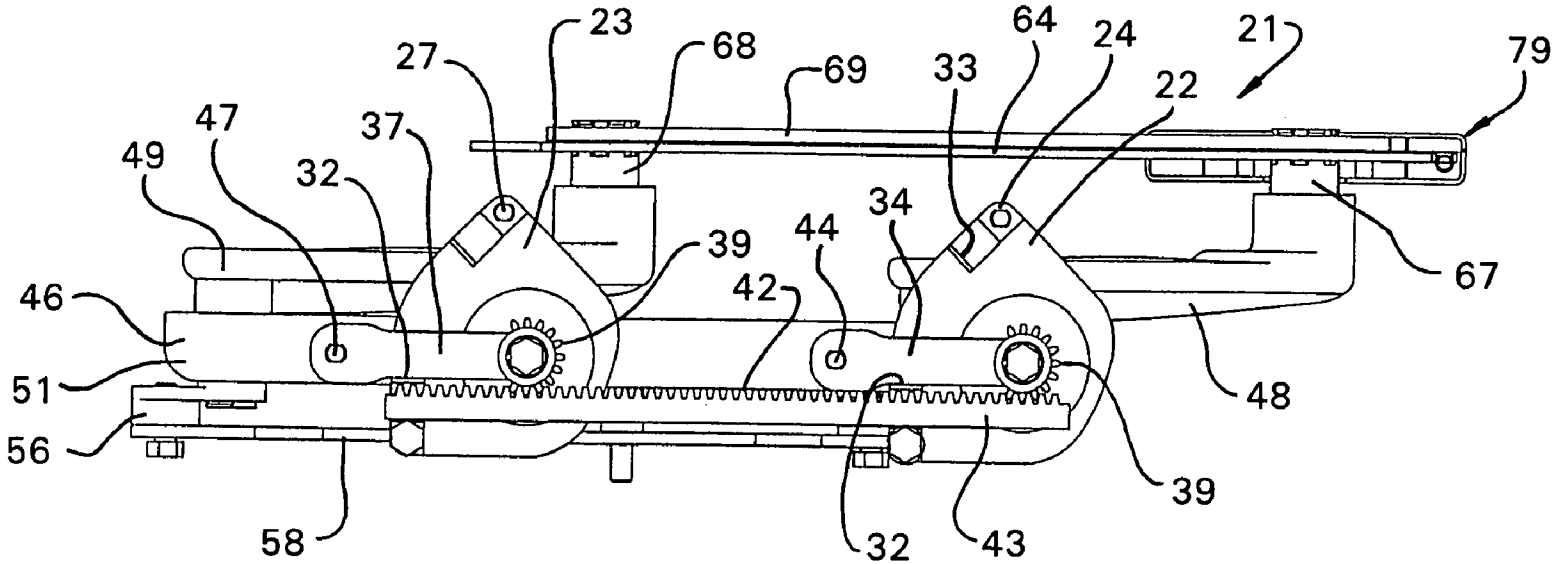
FIGS. 8 and 9 are each a top view of the support assembly and illustrating the various relative positions of the components thereof.
Figure 9:
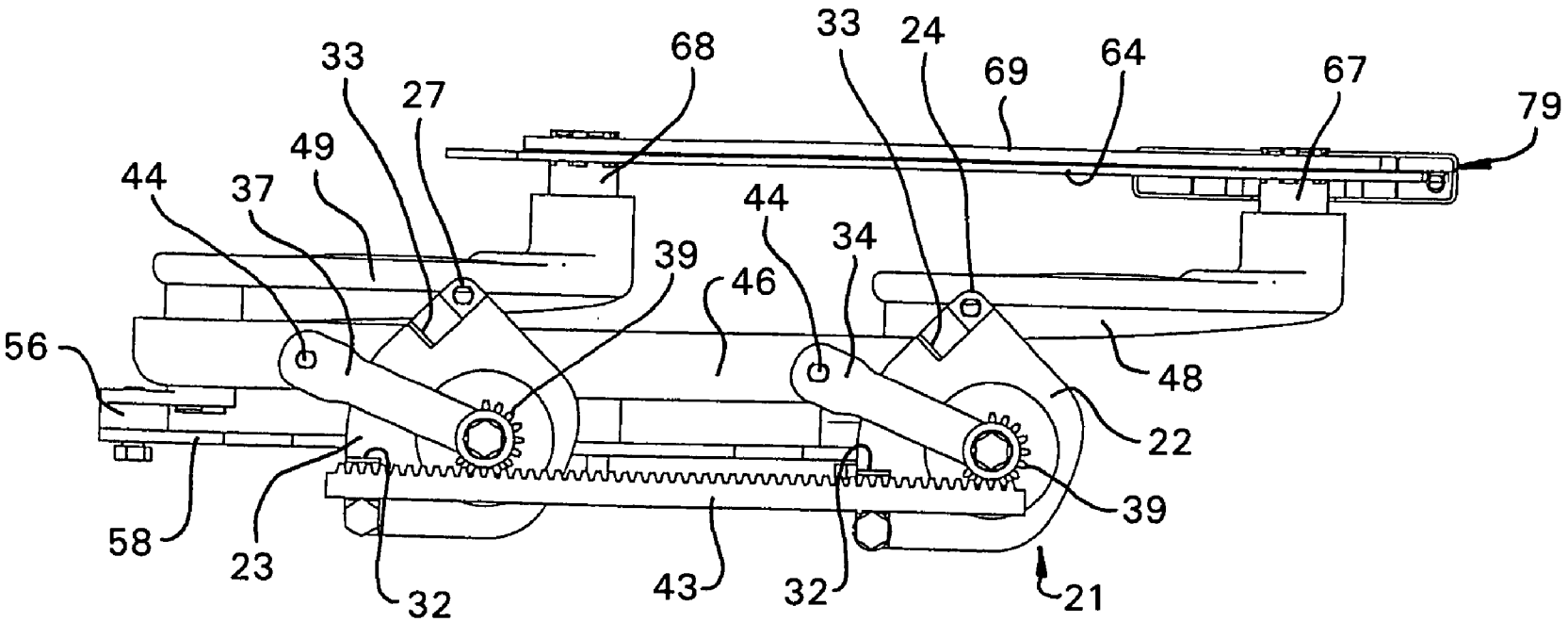
Figure 10:
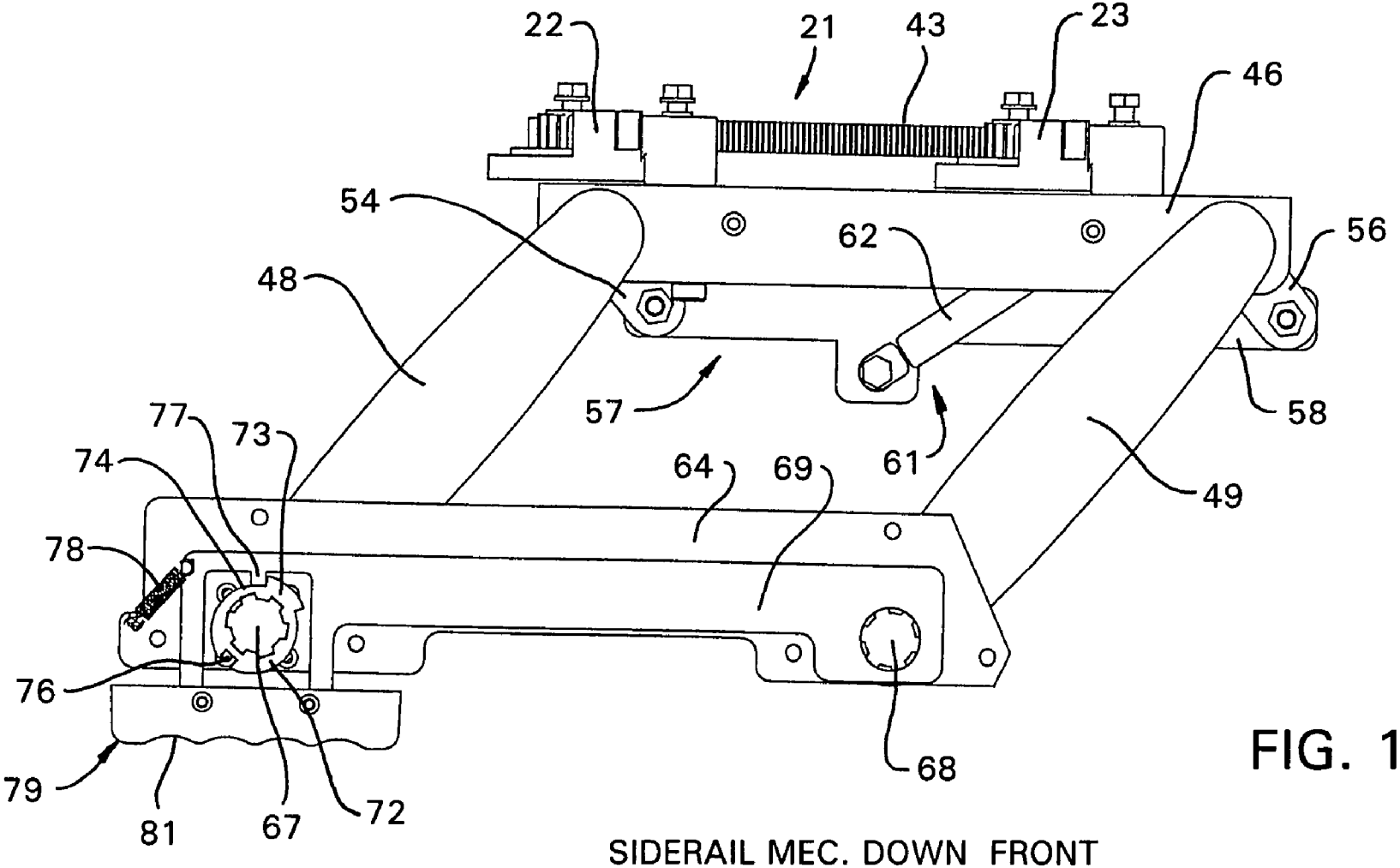
FIGS. 10–12 are each a front view of the support assembly and illustrating the various relative positions of the components thereof.
Figure 11:
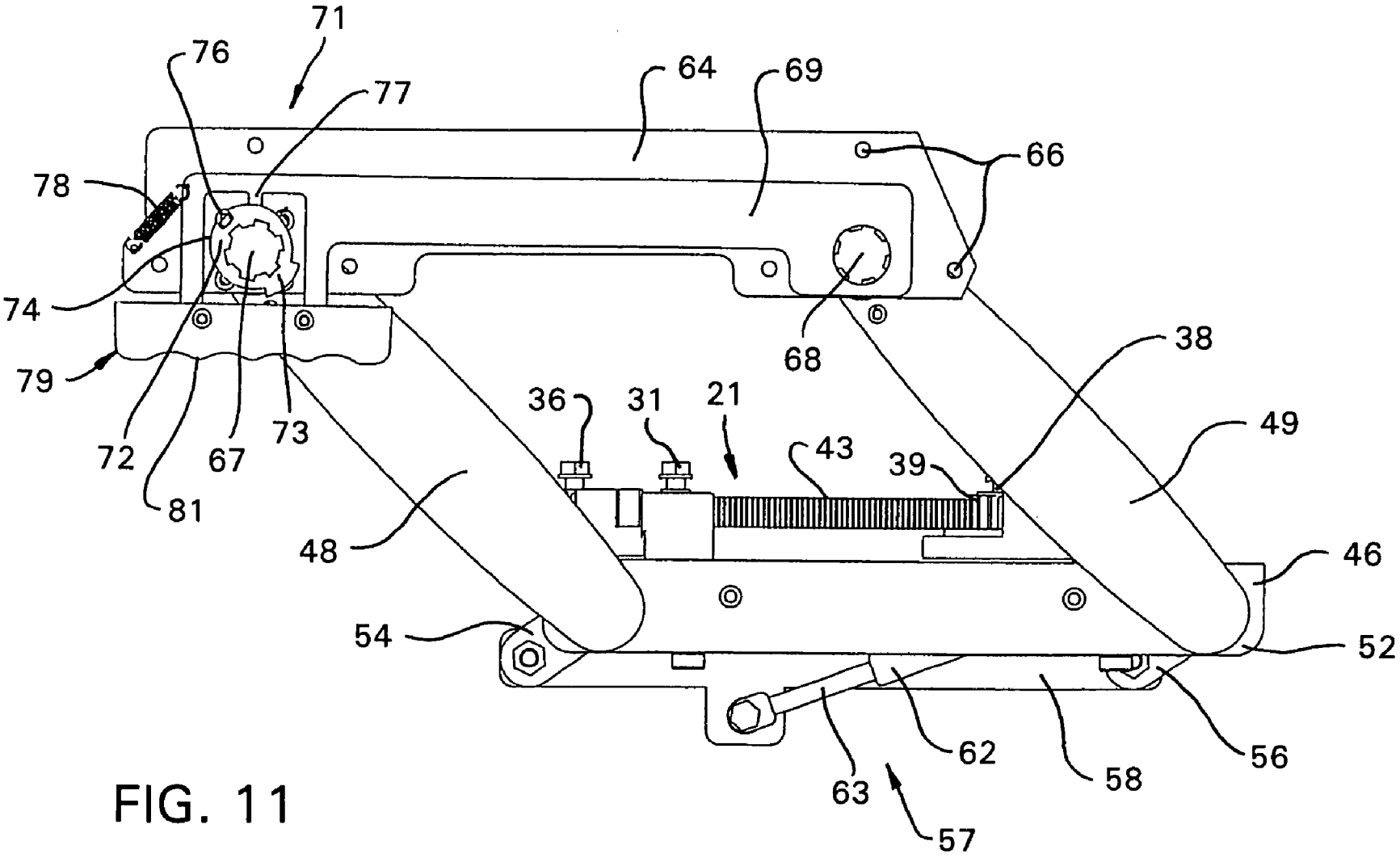
Figure 12:
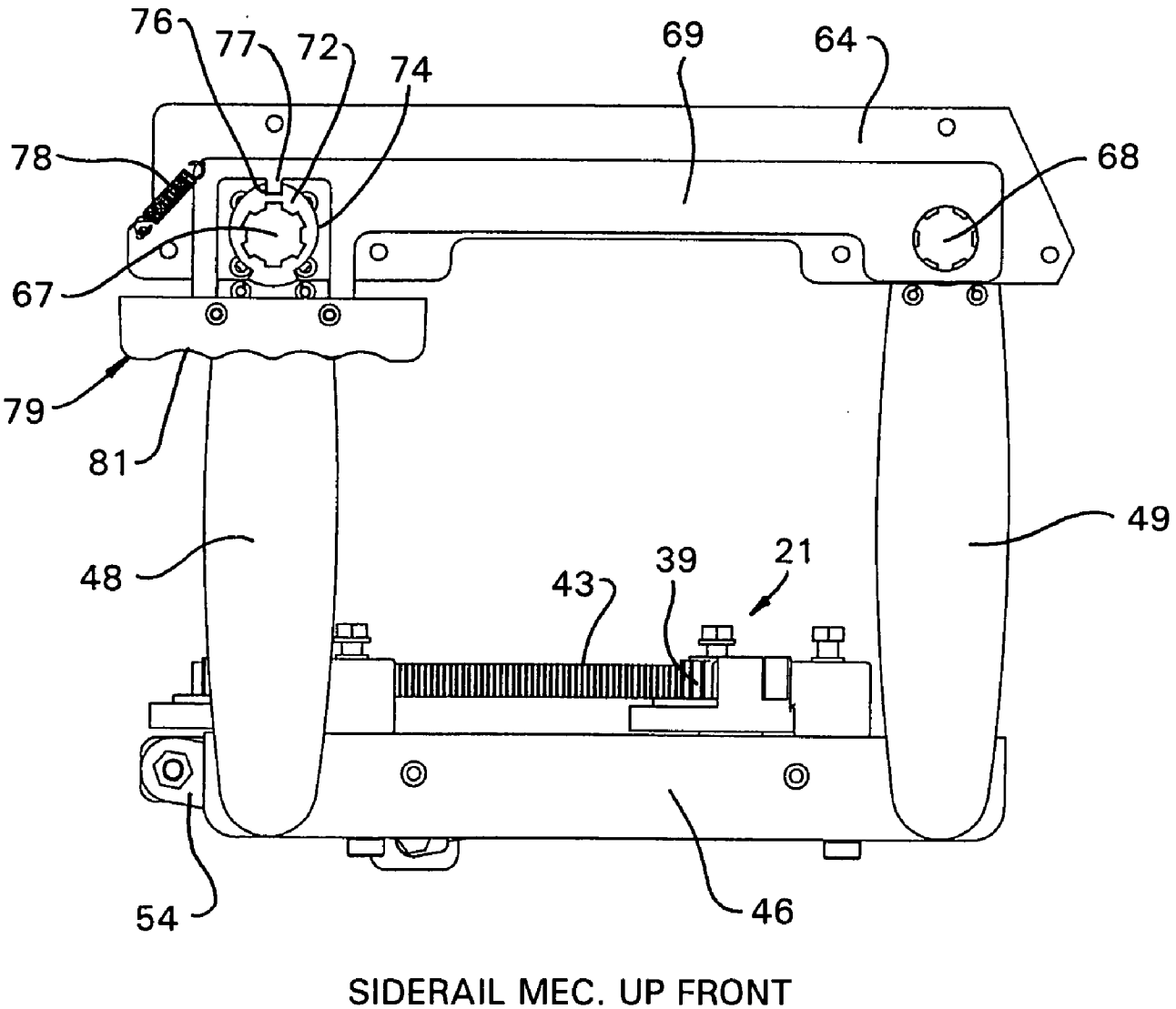
Figure 13:
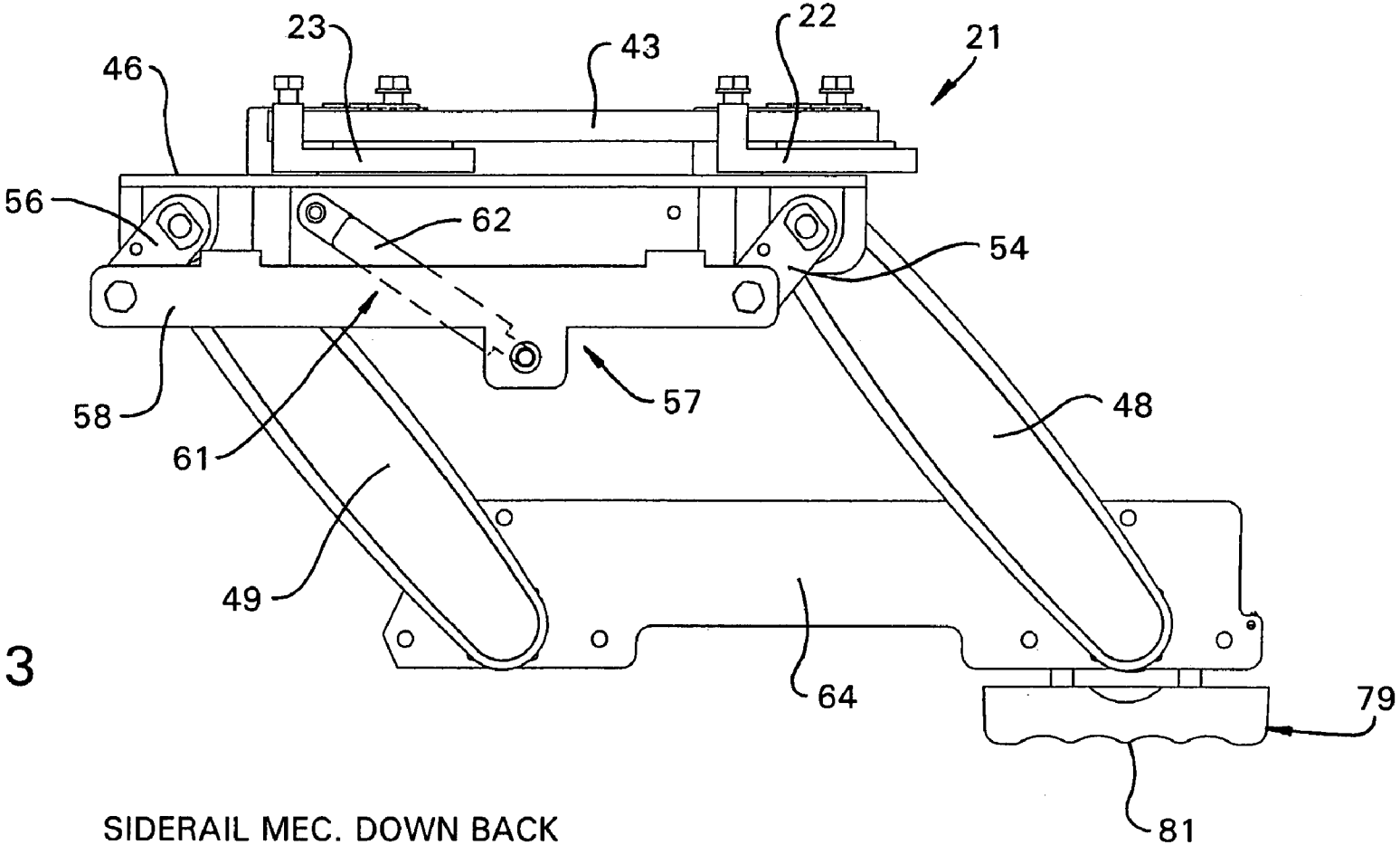
FIGS. 13–15 are each a rearview of the support assembly and illustrating the various relative positions of the components thereof.
Figure 14:
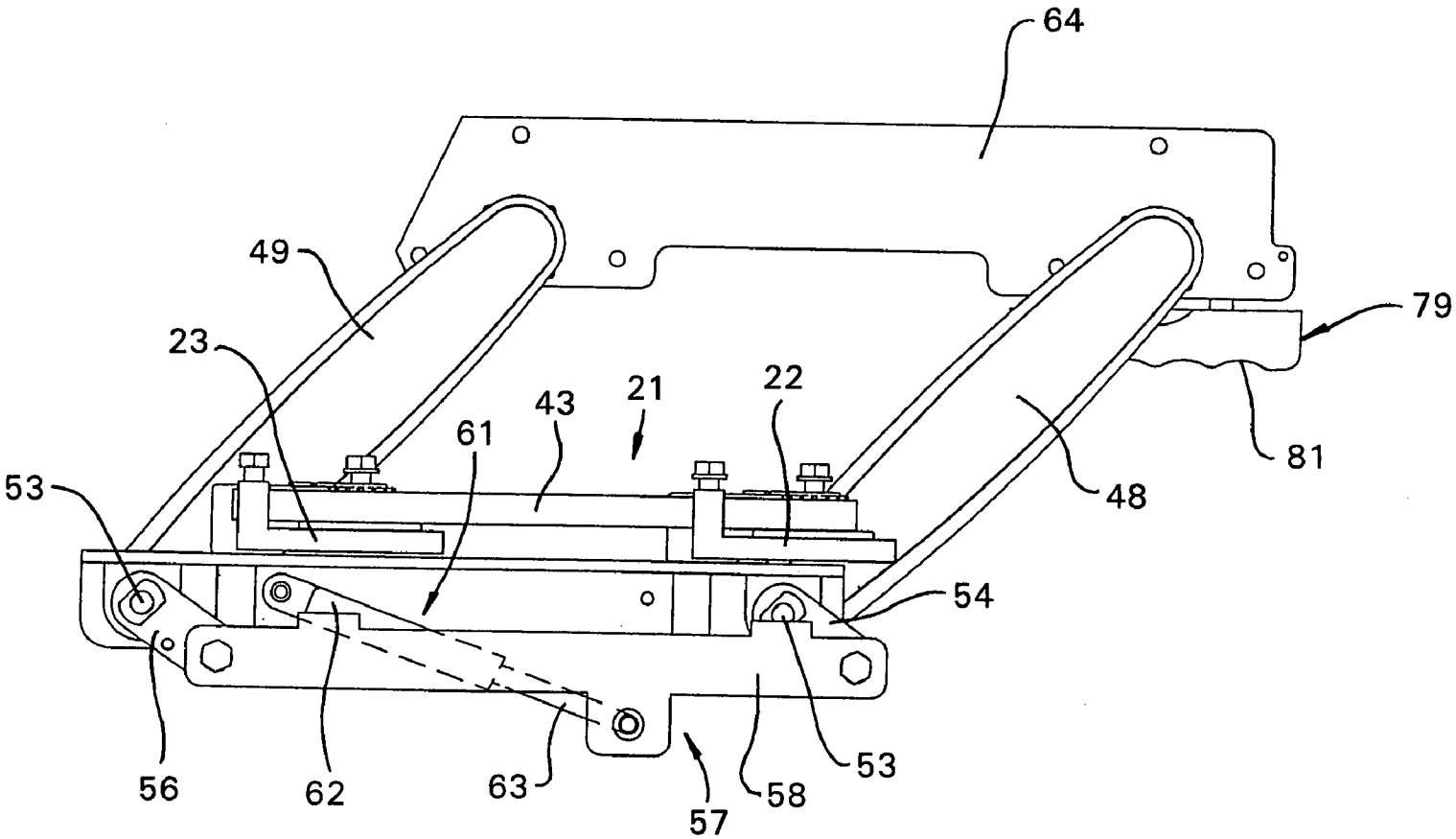
Figure 15:
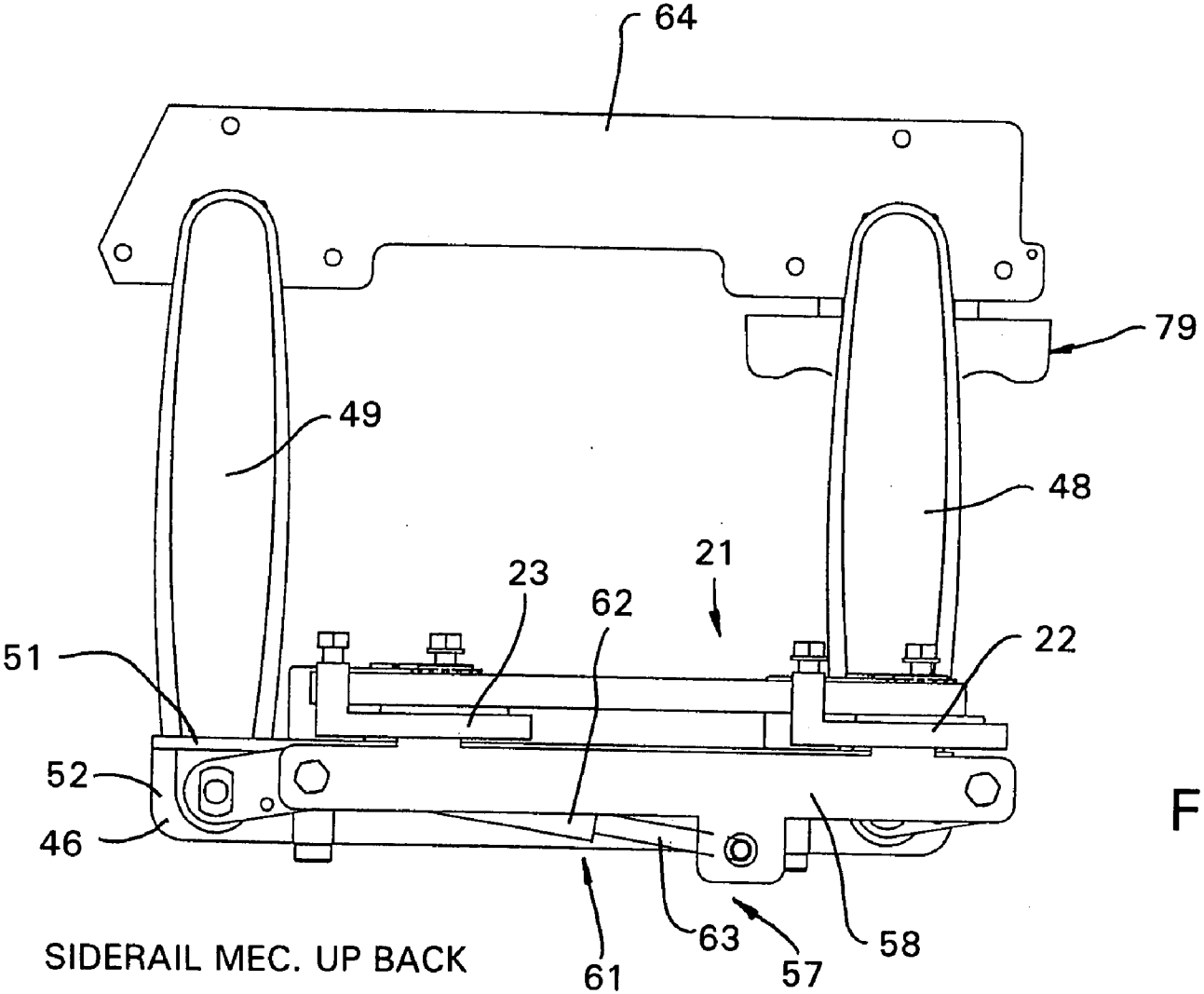

FIGS. 3–15 illustrate a bed siderail support assembly 20. These figures have been divided into four groups, namely, FIGS. 3–7 which illustrate an isometric view from the back side of the structure, namely, from a location proximate a vertical plane 17 containing a longitudinal axis of the bed 10. FIGS. 8 and 9 are a top view of the bed siderail support assembly 20. FIGS. 10–12 are a front view thereof and FIGS. 13–15 are a rear view thereof. It is believed that this grouping of the figures will facilitate a more expedient review of the drawings and an understanding of the invention disclosed herein.

The bed siderail support assembly 20 includes a connecting mechanism 21 configured to mount the bed siderail support assembly 20 to either the frame 11 or a selected one of the head end section 12 and seat section 13, particularly to the undersides thereof. The connecting mechanism 21 includes a pair of identical support members 22 and 23 in the form of a flat plate having on the top side thereof two spaced posts 24 and 26 on the support member 22 and posts 27 and 28 on the support member 23. An internally threaded hole 29 is provided in the upper end of each of the posts 24, 26, 27 and 28 to facilitate the reception therein of a bolt 31. In this particular embodiment, not illustrated holes are provided in either the frame components 11 or the head end section 12 and the seat section 13 to facilitate the reception of the bolts 31 from the top side thereof so as to suspend the support members 22 and 23 from the underside of the frame or the patient support deck 16 by a distance represented by the length of the respective posts 24, 26, 27 and 28.

A guide plate 32 is provided on the support member 22 and a like guide plate 32 is provided on the support member 23. The guide plates 32 are oriented in a plane that extends parallel to the plane 17. The guide plates 32 also serve as a stop as do upstanding plates 33 adjacent the posts 24 and 27 and in a manner that will be explained below.

The connecting mechanism 21 further includes an arm 34 pivotally secured at one end to the support member 22. In this particular embodiment, the pivotal axle for the arm 34 is provided by a bolt 36 that is threadedly engaged with the support member 22. Similarly, an arm 37 is pivotally secured to the support member 23 by a bolt 38. It should be recognized that the thickness of each of the arms 34 and 37 is approximately equal to the height of each of the posts 24, 26, 27 and 28. Further, it should be recognized that only two bolts 31 and 36 as well as bolts 31 and 38 are needed to effect a securement of the support members 22 and 23 to either the frame or the patient support deck 16. Since bed siderail support assemblies are provided on both sides of the bed, the arrangement illustrated in the drawings is readily adapted for use on both sides of the bed by using selected ones of the posts 24, 26, 27 and 28 and the bolts 36 and 38 to effect the requisite securement of the support members 22 and 23 to either the frame or the patient support deck. The drawings illustrate that two bolts 31, 36 and 31, 38 effect the securement of the support members 22 and 23 to either the frame or the patient support deck.

Each of the arms 34 and 37 include a pinion gear 39 that is integrally formed therewith, such as through a molding process. The teeth 41 on each of the pinion gears 39 are configured to mesh with the teeth 42 on an elongate toothed rack 43. Furthermore, the toothed rack 43 is supported for sliding movement on the support members 22 and 23 and between the respective posts 26 and 28 and the opposing guide plates 32, respectively. Furthermore, the pivot range for each of the arms 34 and 37 is limited to the region between the plates 32 and 33. The toothed rack 43 slides lengthwise in response to a pivotal movement of the arms 34 and 37 and in a direction that is generally parallel to the plane 17.

The end of the arm 34 remote from the pinion gear 39 is connected by a pin 44 to an elongate mount 46. Similarly, the end of the arm 37 remote from the pinion gear 39 is connected by means of a pin 47 to the aforesaid mount 46. The axes of the pins 44 and 47 are parallel to the pivot axes represented by the axes of the bolts 36 and 38. In this particular embodiment, the aforesaid pivot axes are each contained in a vertical plane.

The mount 46 has a pair of secondary arms 48 and 49 pivotally secured thereto. In this particular embodiment, the mount 46 is an L-shaped member with the pins 44 and 47 being received into a hole provided on the horizontal leg 51 of the mount. The secondary arms 48 and 49 are each pivotally secured to a vertically extending leg 52 of the mount 46. The secondary arms 48 and 49 are each pivotally secured to the vertical leg 52 of the mount 46 by means of an axle pin 53. Each secondary arm 48 and 49 is fixedly secured to the axle pins 53. The axes of the axle pins each extend in a horizontal plane. On a side of the vertical leg 52 of the mount 46 opposite from the secondary arms 48 and 49 there is provided a further arm 54 and 56 which is fixedly secured to the axle pins 53. A linkage mechanism 57 interconnects the distal ends of each of the further arms 54 and 56. More specifically, the linkage mechanism 57 includes an elongate link 58 connected at the opposite ends thereof to the distal ends of the respective further arms 54 and 56 by means of a bolt 59. The linkage mechanism 57 further includes a spring mechanism 61 connected between the mount 46 and the link 58. In this particular embodiment, the spring mechanism 61 is a conventional gas type spring having a body 62 and an extendible and retractable member 63. The spring mechanism facilitates an unrestricted extension of the member 63 but a restricted and controlled retraction of the member 63. The purpose of this characteristic will be explained in more detail below.

A support plate 64 is pivotally secured to the distal ends of each of the secondary arms 48 and 49. The support plate 64 is configured to have mounted thereon a bed siderail 14. For example, the bed siderail 14 is configured to have a pocket therein adapted for reception of the support plate 64 with appropriate screws being provided to effect a securement of the siderails to the support plate 64 by the screws being received in selected ones of the plurality of holes 66 provided on the support plate.

In this particular embodiment, the distal ends of the secondary arms 48 and 49 have each fixedly secured thereto a splined axle pin 67 and 68, respectively. The splined axle pins 67 and 68 are each rotatably supported relative to the support plate 64 and about axes that are contained in a horizontal plane. An elongate lever arm 69 is pivotally supported on the axle pin 68 on a side thereof remote from the lever arm 49 and for movement about the axis of the axle pin 68. The lever arm extends between the axle pins 67 and 68 with the end thereof adjacent the axle pin 67 having a latch mechanism 71 thereat configured to lock the lever arm 69 to the axle pin 67. More specifically, the axle pin 67 has a cam member 72 (FIGS. 10–12) with an internally splined opening receiving therein the external splines on the axle pin 67 so that the cam 72 will rotate with the axle pin 67. The cam has a radially outwardly extending shoulder 73 so that the peripheral surface 74 of the cam 72 extends between the shoulder 73 and defines a surface, the midpoint of which has a pocket 76 therein. The lever arm 69 carries a pawl 77 that slides on the peripheral surface 74. A spring 78 extends between the support plate 64 and the distal end of the lever arm 69 to cause the pawl 77 to be continually urged into engagement with the peripheral surface 74 and, when the pocket 76 becomes aligned therewith, the spring 78 will urge the pawl 77 into the pocket as illustrated in FIG. 12. When the pawl 77 is received in the pocket 76, the support plate 64 will become locked to the axle pin 67 and, as a result, neither of the two secondary arms 48 and 49 will be permitted to pivot until the pawl 77 is removed from the pocket 76.

A handle 79 is secured to the distal end of the lever 69. The handle 79 has a downwardly facing grip surface 81 that is configured to be manually contacted to effect a lifting of the distal end of the lever arm 69 against the urging of the spring 78 and about the axis of the splined axle pin 68 to move the pawl away from the pocket 76. Such a movement will unlock the support plate 64 from the axle pin 67 and facilitate a pivotal movement of the support plate relative to each of the secondary arms 48 and 49.

OPERATION

Although the operation of the mechanism described above will be understood from the foregoing description by skilled persons, a summary of such description is now given for convenience.

Figure 2:
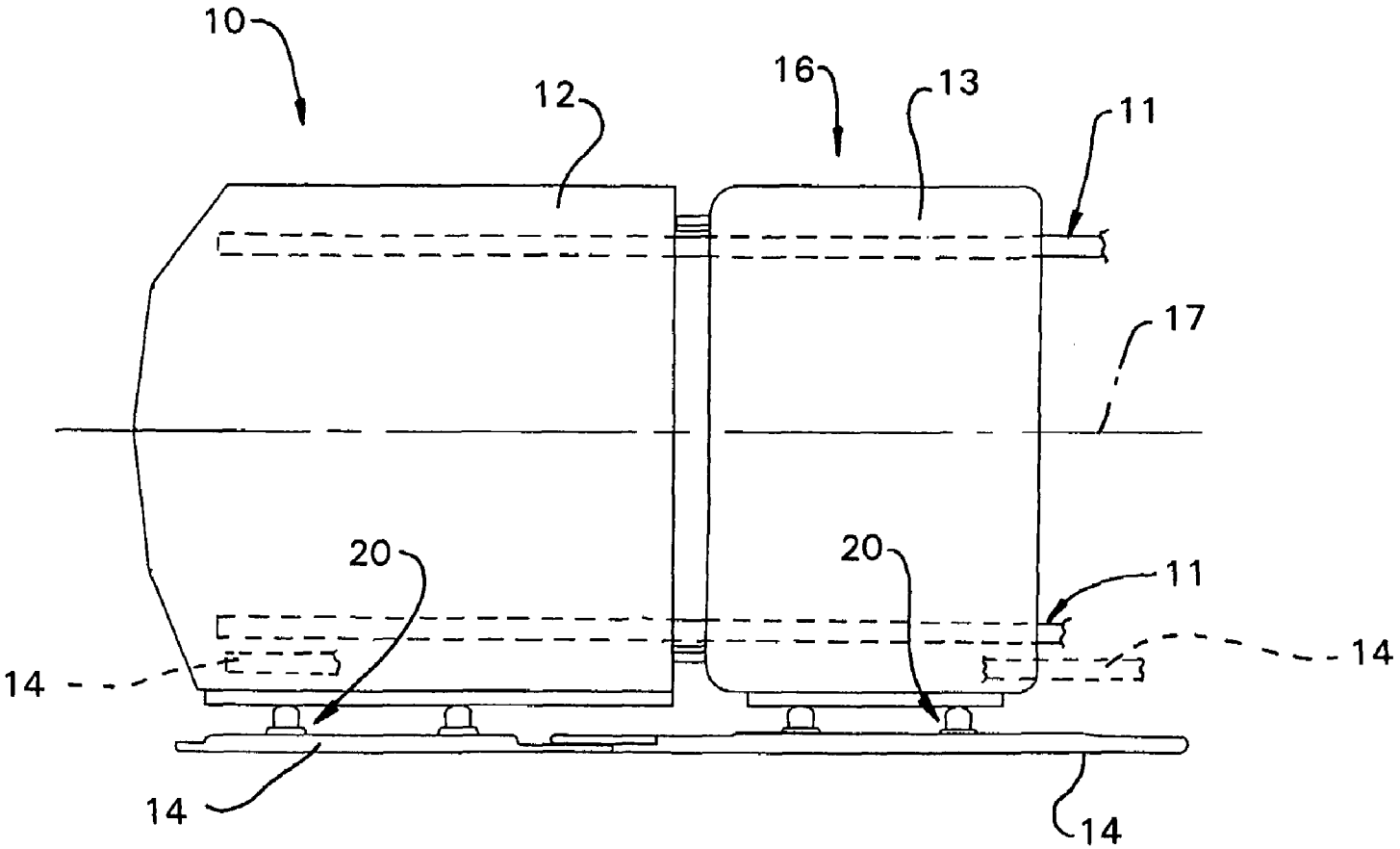
FIG. 2 is a top view of FIG. 1.

The siderail support assemblies 20 support the siderail for movement between a stowed position illustrated in broken lines in FIG. 2 and a deployed position illustrated in solid lines in FIGS. 1 and 2. The following discussion pertaining to the operation of the bed siderail support assembly 20 will begin with the siderail 14 being in the stowed position illustrated in broken lines in FIG. 2.

Figure 3:
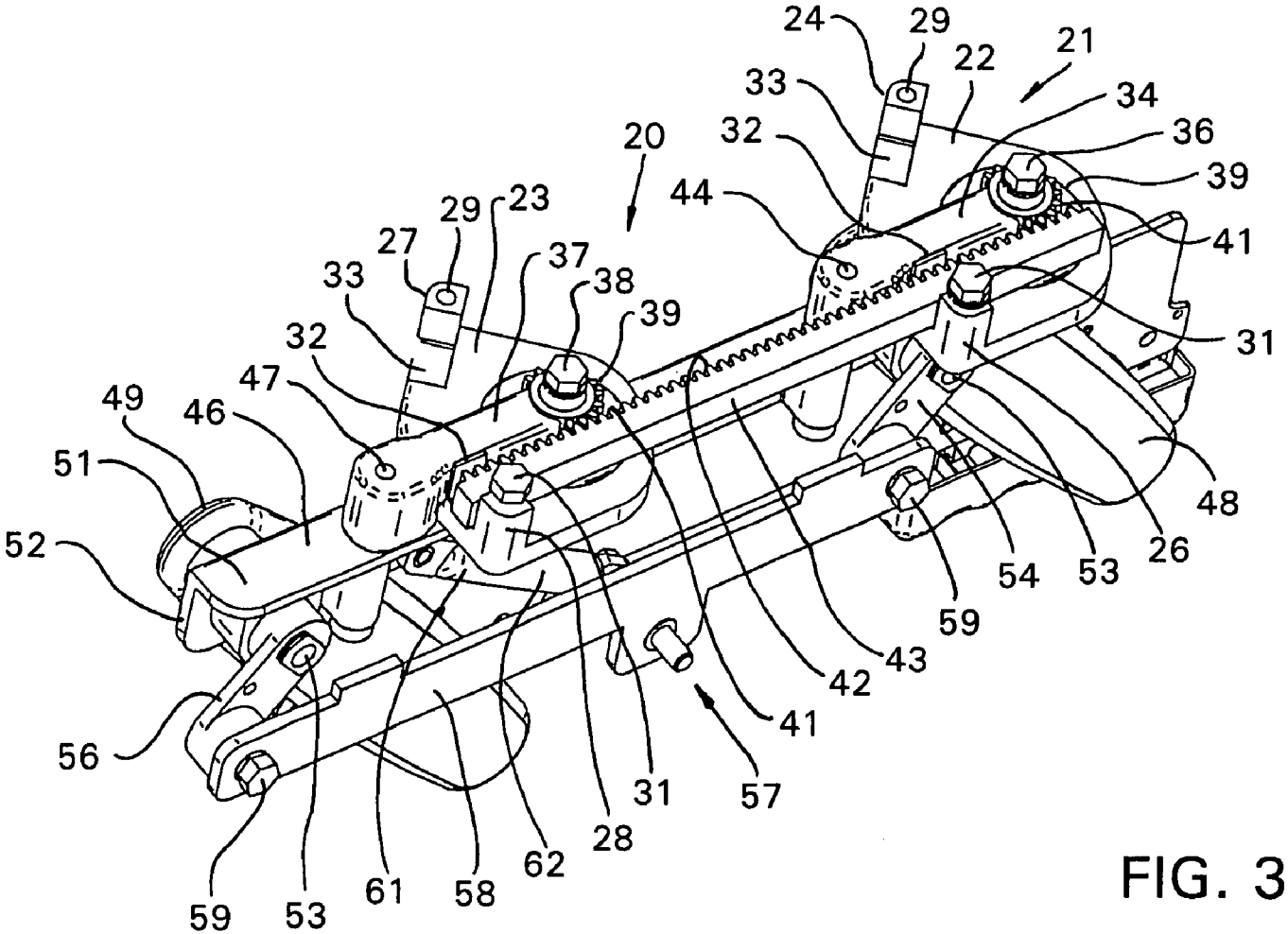
FIGS. 3–7 are each an isometric view of various stages of movement of the support assembly.
Figure 4:
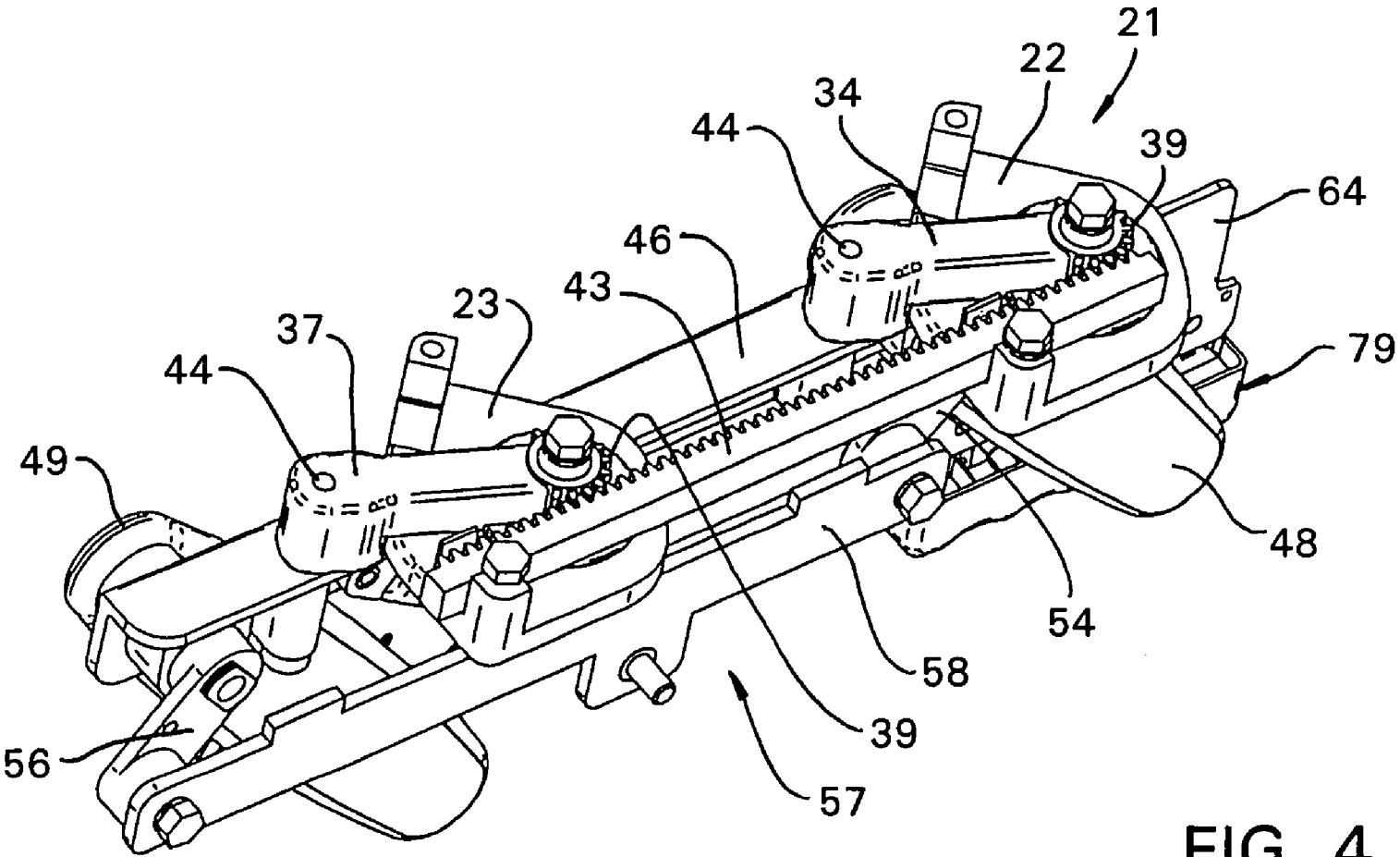
Figure 5:
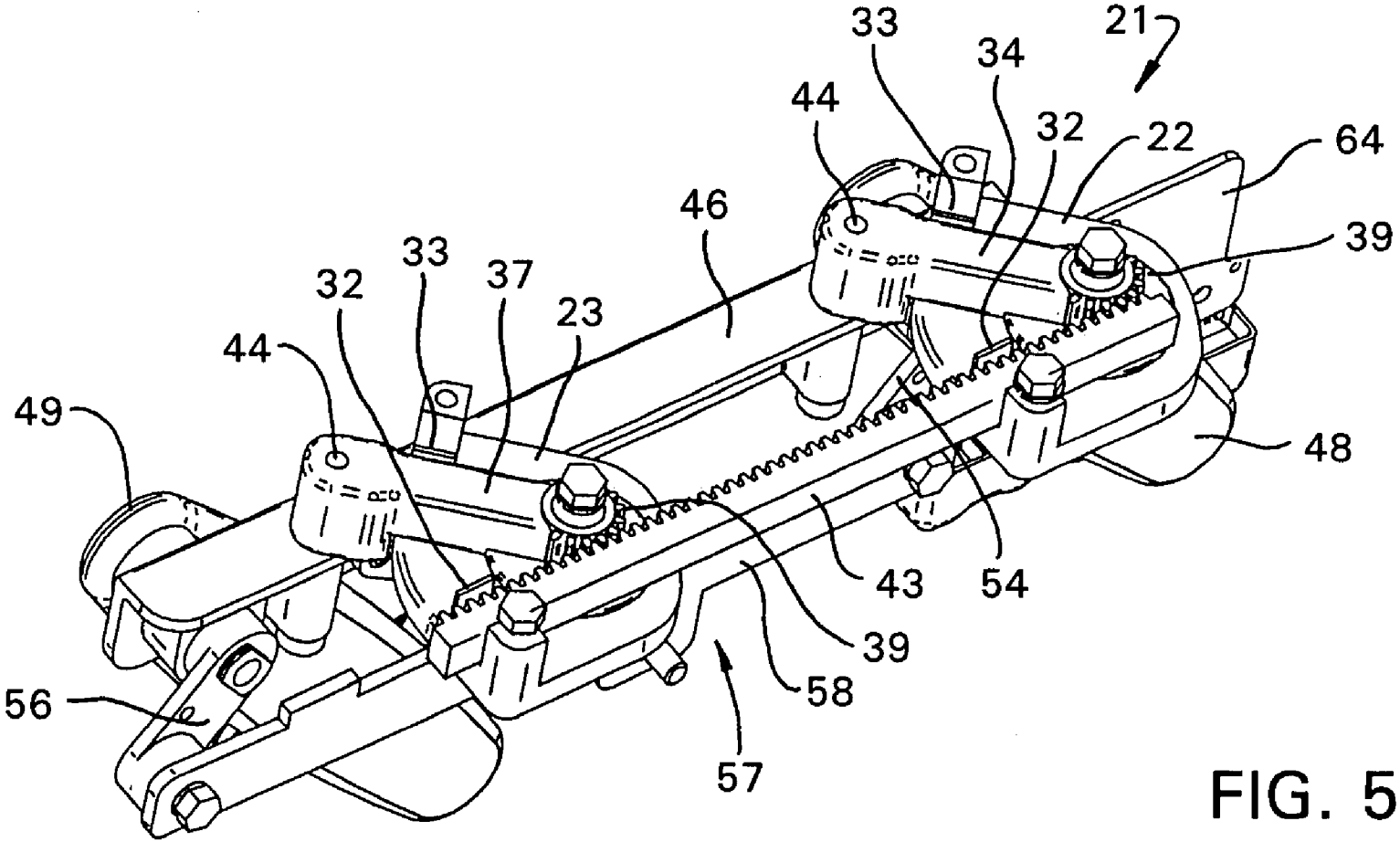

FIGS. 3 and 8 illustrate the same position, but from different angles. The siderail 14 secured to the support plate 64 is now stowed beneath the patient support deck 16. FIGS. 4 and 9 illustrate the same relative position of the components, but with the mount 46 being moved approximately half way out from underneath the patient support deck 16. FIGS. 5, 10 and 13 illustrate the same position, namely, a position whereat the mount 46 is now completely out from underneath the patient support deck, namely, in the position represented in solid lines in FIG. 2 but with the support plate 64 being in the lowered position. FIG. 10 is a front view of the arrangement whereas FIG. 13 is a rear view of the same arrangement. It will be noted in FIG. 10 that the pawl 77 is adjacent the shoulder 73 and is configured to slide on the outer peripheral surface 74 of the cam 72. During the aforesaid movement of the mount 46 from the stowed position illustrated in FIGS. 5, 10 and 13 to the deployed position illustrated in FIGS. 7, 12 and 15, the pinion gears 39 will have rotated with the respective arms 34 and 37 to cause a longitudinal movement of the toothed rack 43.

Figure 6:
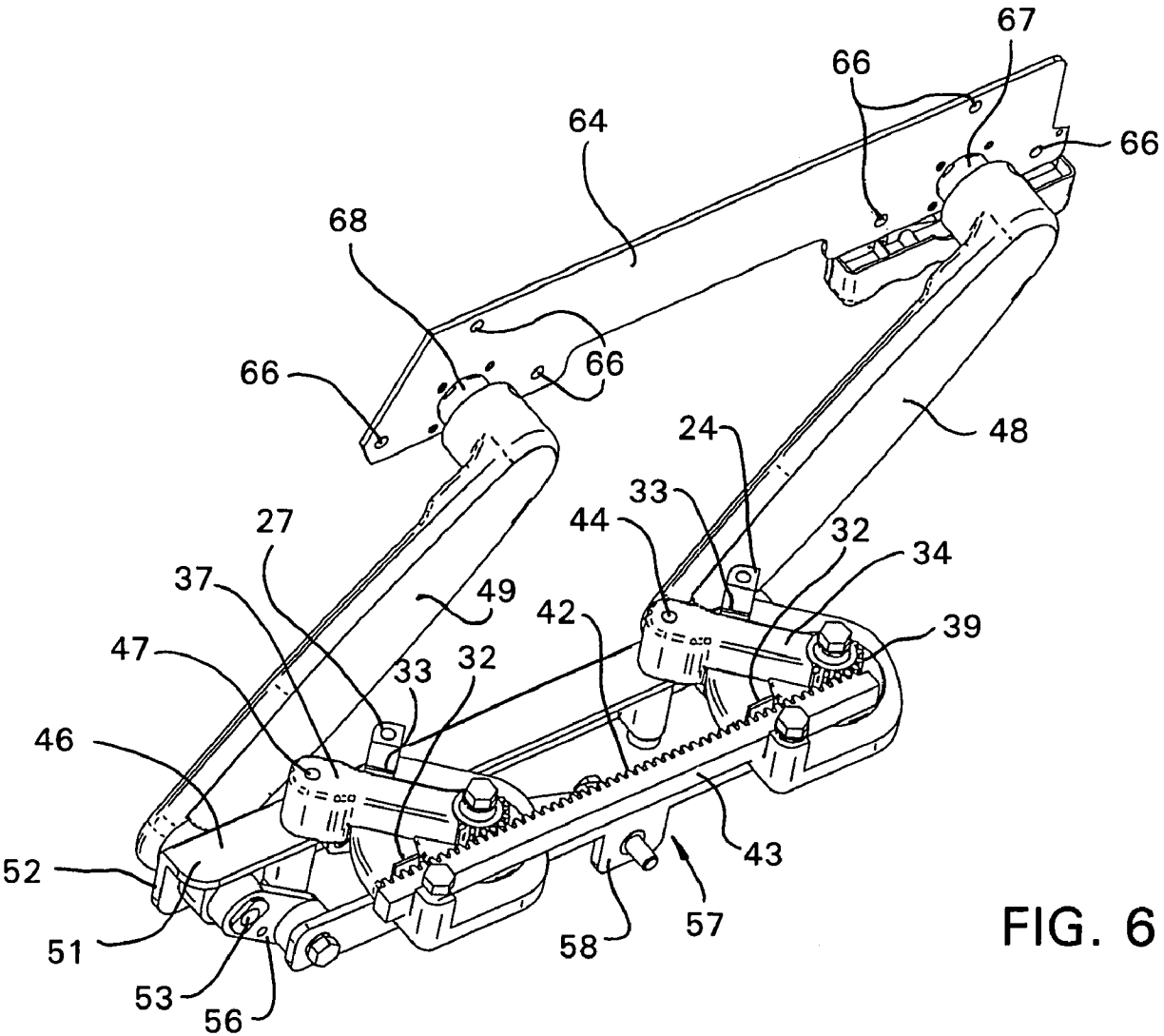

FIGS. 6, 11 and 14 illustrate the same relative position of the components. Here, the support plate 64 is elevated midway between the down position illustrated in FIGS. 5, 10 and 13 and the fully raised position illustrated in FIGS. 7, 12 and 15. It will be noted that the pawl 77 is now continuing to slide on the peripheral surface 74 of the cam 72 and the pocket 76 is approaching the pawl. FIGS. 7, 12 and 15 illustrate the same position, namely, the support plate 64 is now in the fully deployed position corresponding to that illustrated in FIGS. 1 and 2. Here it will be noted that the pawl 77 has now been urged by the spring 78 into the pocket 76 to lock the support plate 64 to the secondary arm 48. In order to effect an unlocking of the latch mechanism 71 which secures the support plate 64 to the secondary arm 48, the grip surface 81 is manually gripped by an attendant and lifted against the urging of the spring 78 to cause the pawl 77 to be lifted out of the pocket 76. Thereafter, the support plate 64 can be urged in the direction represented by the illustration in FIGS. 6, 11 and 14 and thence to the fully down position illustrated in FIGS. 5, 10 and 13, the spring mechanism 61 serving to slow the descent of the support plate 64.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A bed siderail support assembly, comprising:

a frame;

a support deck mounted on said frame and having an upwardly facing side and a downwardly facing side, said support deck having a head end, a foot end and opposite lateral edges extending between said head end and said foot end;

at least one siderail oriented along side of at least one of said lateral edges;

a connecting mechanism configured to connect said at least one siderail to one of said frame and said downwardly facing side of said support deck, said connecting mechanism including:

a support configured for securement of said one of said frame and said support deck;

an elongate toothed rack longitudinally movably mounted on said support;

a pair of parallel arms pivotally mounted on said support for movement about parallel axes of rotation lying in a plane that extends parallel to a longitudinal axis of said elongate toothed rack;

toothed pinion gears on each arm each supported for movement with a respective arm about a respective said axis of rotation of said respective arm, the teeth of each said toothed pinion gear meshing with the teeth on said rack; and a mount pivotally secured to each of said arms at a location radially spaced from said axes of rotation, said mount being configured to support thereon a bed siderail.

2. The bed siderail support assembly according to claim 1, wherein said parallel arms each have a longitudinal axis and are configured to pivot between a first position whereat said longitudinal axes thereof are parallel to said longitudinal axis of said toothed rack and a second position whereat said longitudinal axes thereof form an angle with said longitudinal axis of said toothed rack, said toothed rack being configured to move lengthwise in response to pivotal movement of said arms so as to assure that said arms will always be parallel to each other.

3. The bed siderail support assembly according to claim 2, wherein said support is oriented laterally from said at least one lateral edge and beneath said support deck, said mount being positioned in a first position beneath said deck when said arms are in said first position and being positioned in a second position laterally outside said at least one lateral edge when said arms are in said second position.

4. The bed siderail support assembly according to claim 3, wherein said support is secured to and suspended by a spacer mechanism a finite distance from said downwardly facing side of said support deck, said support including two pairs of fixed stops limiting the pivotal movement of said arms therebetween, said arms being oriented between said support and said downwardly facing side of said support deck.

5. The bed siderail support assembly according to claim 4, wherein said toothed rack is guided for said longitudinal movement between one of said fixed stops in each pair and one spacer mechanism on said support.

6. The bed siderail support assembly according to claim 1, wherein said mount is pivotally secured to each arm about an axis contained in a vertical plane extending parallel to said longitudinal axis of said elongate toothed rack.

7. The bed siderail support assembly according to claim 6, wherein said mount includes a pair of secondary arms pivotally secured thereto at one end and being supported for movement about a first axis contained in a first horizontal plane, and a support plate pivotally secured to a distal end of each secondary arm and for relative movement about a second axis contained in a second horizontal plane, said support plate being configured to support said bed siderail thereon.

8. The bed siderail support assembly according to claim 7, wherein said support plate includes a releasable latch mechanism configured to lock said support plate to at least one of said secondary arms so as to prevent relative movement therebetween.

9. The bed siderail support assembly according to claim 8, wherein said latch mechanism includes a movable pawl mounted on said support plate and a spring mechanism continually urging said pawl to a first position thereof and a rotatably mounted wheel-like member mounted on one of said secondary arms and having at least one pocket on a peripheral surface thereof, said pawl slidingly engaging said peripheral surface until said pawl is directly aligned with said pocket at which time said spring mechanism urges said pawl into said pocket to effect said lock of said support plate to at least one of said secondary arms.

10. The bed siderail support assembly according to claim 9, wherein said movable pawl is a lever arm pivotally supported for movement about a first of said second axes and said wheel-like member is fixed to said distal end of said secondary arm and is movable about a second of said second axes.

11. The bed siderail support assembly according to claim 10, wherein said lever arm includes a manually engageable handle configured to cause said pawl to exit said pocket in response to a manual force applied to said handle.

12. The bed siderail support assembly according to claim 11, wherein said handle is oriented directly beneath said pawl.

13. The bed siderail support assembly according to claim 7, wherein each secondary arm includes fixedly secured thereto a further arm extending parallel to each other and a link mechanism pivotally secured to a distal end of each further arm.

14. The bed siderail support assembly according to claim 13, wherein said link mechanism includes a link and a spring mechanism interconnecting said link and said mount.

15. The bed siderail support assembly according to claim 14, wherein said spring mechanism is configured to counterbalance a combed weight of at least said mount, said secondary arms and a bed siderail secured to said mount.

* * * * *